US008206137B2

(12) United States Patent
Sakamoto et al.

(10) Patent No.: US 8,206,137 B2
(45) Date of Patent: Jun. 26, 2012

(54) CYLINDER APPARATUS, COMPRESSOR AND MANUFACTURING METHOD OF CYLINDER APPARATUS

(75) Inventors: Susumu Sakamoto, Kanagawa (JP); Daisuke Takahashi, Kanagawa (JP); Junichi Nagasawa, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 780 days.

(21) Appl. No.: 12/292,912

(22) Filed: Dec. 1, 2008

(65) Prior Publication Data

US 2009/0148322 A1 Jun. 11, 2009

(30) Foreign Application Priority Data

Nov. 30, 2007 (JP) ..... 2007-311358

(51) Int. Cl.
*F16J 10/00* (2006.01)
*F16J 10/02* (2006.01)

(52) U.S. Cl. ..... 417/559; 92/169.1; 92/171.1; 92/169.4; 417/481; 417/561; 417/571

(58) Field of Classification Search ..... 417/559–571, 417/415; 92/169.1–171.1
See application file for complete search history.

(56) References Cited

U.S. PATENT DOCUMENTS

| | | | | |
|---|---|---|---|---|
| 3,695,150 | A * | 10/1972 | Salzmann | 92/169.1 |
| 4,272,229 | A * | 6/1981 | Pape | 417/481 |
| 4,540,352 | A * | 9/1985 | Becker | 417/571 |
| 5,769,048 | A * | 6/1998 | Salzmann | 123/197.2 |
| 2006/0193735 | A1 | 8/2006 | Suzuki et al. | |

FOREIGN PATENT DOCUMENTS

| | | | |
|---|---|---|---|
| CN | 1828056 | A | 9/2006 |
| DE | 2 161 841 | | 6/1973 |
| EP | 0 390 882 | B1 | 10/1990 |
| JP | 07-091374 | A | 4/1995 |
| WO | WO 90/02867 | A1 | 3/1990 |
| WO | WO 9424436 | A1 * | 10/1994 |

OTHER PUBLICATIONS

Chinese Office Action dated Mar. 3, 2010 (eight (8) pages).

* cited by examiner

*Primary Examiner* — Mariceli Santiago
(74) *Attorney, Agent, or Firm* — Crowell & Moring LLP

(57) ABSTRACT

There is provided a cylinder apparatus consisting of a cylinder, a piston performing reciprocating motion between a top dead point and a bottom dead point with oscillatory movement in the cylinder, wherein the cylinder has an oscillatory distance between the top dead point and the bottom dead point, which is shorter than the oscillatory distance at the top and bottom dead points.

8 Claims, 9 Drawing Sheets

CYLINDER APPARATUS, COMPRESSOR AND MANUFACTURING METHOD OF CYLINDER APPARATUS

BACKGROUND OF THE INVENTION

1. Field of the Invention

The present invention relates to a cylinder apparatus, a compressor and a manufacturing method of the cylinder apparatus.

2. Description of the Related Art

There conventionally exist cylinder apparatuses in which a piston performs reciprocating motion with oscillatory movement in a cylinder (refer to, for example, Japanese Patent Application Laid-Open No. H07-91374). In the cylinder apparatuses, since the piston oscillates, clearance formed between the cylinder and the piston is varied depending on positions of the piston, whereby capability for retaining compressed air in a cylinder chamber has been inevitably deteriorated due to the oscillatory movement of the piston.

SUMMARY OF THE INVENTION

The present invention has been made in light of the above problem, and it is an object of the present invention to provide a cylinder apparatus, a compressor and a manufacturing method of the cylinder apparatus which successfully resolve problems caused by structural relation between a cylinder and a piston where the piston performs reciprocating motion with oscillatory movement in the cylinder thereby generating clearance between the cylinder and the piston depending on positions of the piston.

In order to achieve the object described above, according to a first aspect of the present invention, there is provided a cylinder apparatus comprising: a cylinder; a piston performing reciprocating motion between a top dead point and a bottom dead point with oscillatory movement in the cylinder, wherein the cylinder has an oscillatory distance between the top dead point and the bottom dead point, which is shorter than the oscillatory distance at the top and bottom dead points.

According to a second aspect of the present invention, there is provided a compressor in an oscillatory method comprising: a tubed cylinder; a piston performing reciprocating motion between a top dead point and a bottom dead point with oscillatory movement in the cylinder; an intake valve inhaling gas into the cylinder; and an exhaust valve exhausting gas from the cylinder, wherein a cross-sectional configuration of the cylinder is identical with the one of the piston placed either at the top dead point and the bottom dead point, and the cross-sectional configuration of the cylinder placed between the top and bottom dead points is varied corresponding to a configuration formed by oscillatory trajectories along which an outer periphery of the piston moves.

According to a third aspect of the present invention, there is provided a manufacturing method of a cylinder apparatus, the cylinder apparatus being provided with a circular piston performing reciprocating motion with oscillatory movement in a tubed cylinder, comprising the steps of: relatively rotating a cutting member to the cylinder, the cutting member processing an inner periphery of the cylinder; relatively moving the cutting member in an axial direction of the cylinder; and relatively oscillating the cutting member to the cylinder so as to perform a cutting process to the cylinder.

BRIEF DESCRIPTION OF THE DRAWINGS

FIG. 4 also indicates two-dot-chain-line trajectories made by tips of the piston portion moving in an oscillatory manner through a compression process of the piston portion.

FIG. 5 also indicates broken-line trajectories made by tips of the piston portion moving in an oscillatory manner through an inhale process of the piston portion.

FIG. 6 also indicates trajectories made by tips of the piston portion moving in an oscillatory manner through a compression process and an inhale process of the piston portion by two-dot-chain-line and broken-line, respectively.

DETAILED DESCRIPTION OF THE PREFERRED EMBODIMENTS

Preferred embodiments of the present invention will be explained based on the accompanying drawings. The cylinder apparatus, the compressor and the manufacturing method of the cylinder apparatus according to the present invention are not limited to later-described materials, shapes and configurations, and other selections may be made if the object of the invention is achieved.

The cylinder apparatus and the compressor including the cylinder apparatus according to a first embodiment of the present invention will be explained with reference to FIGS. 1 to 11.

Figure 1:
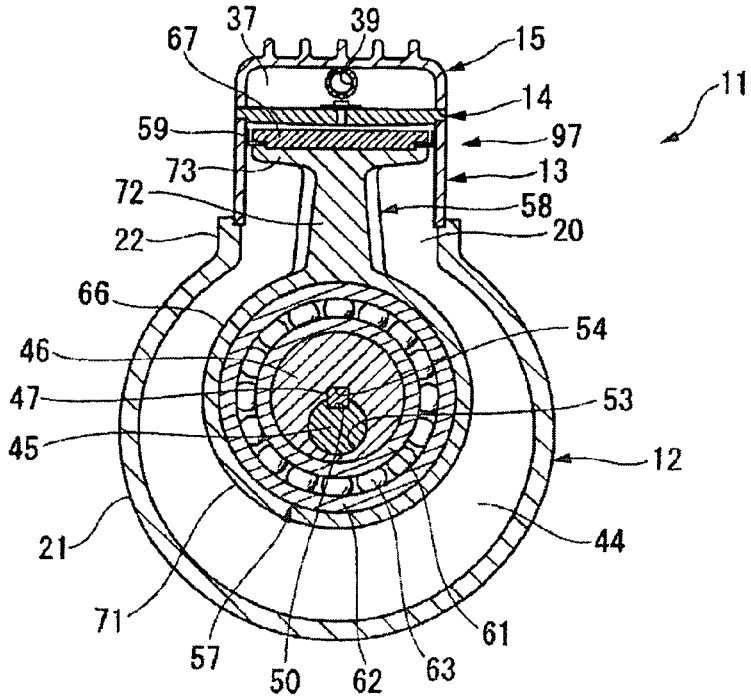
FIG. 1 is a cross-sectional view showing an overall architecture of a compressor including a cylinder apparatus according to a first embodiment of the present invention.
Figure 2:
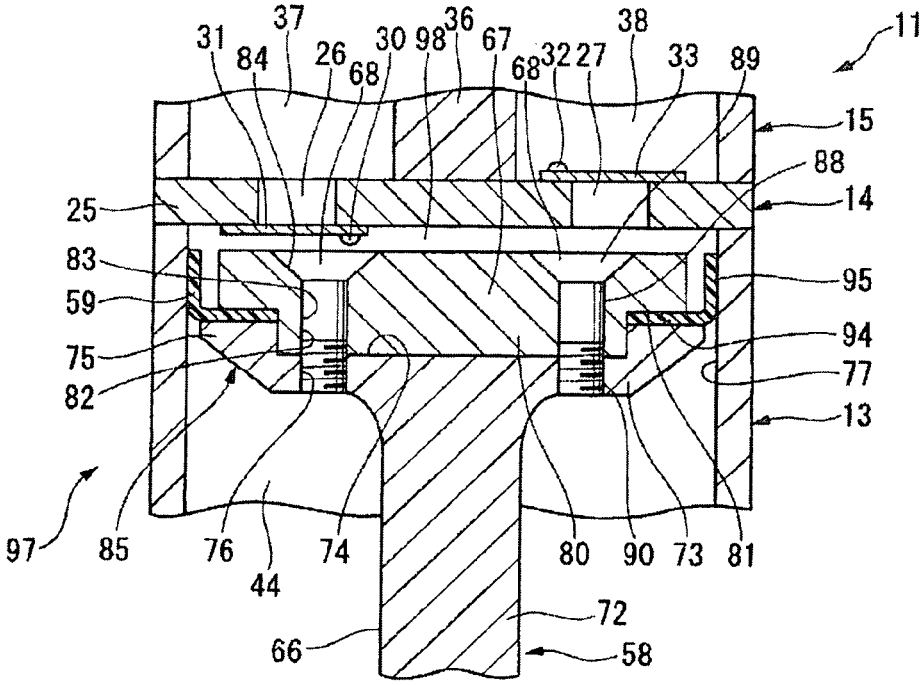
FIG. 2 is a cross-sectional view showing featured portions of the compressor including the cylinder apparatus.
Figure 3A:
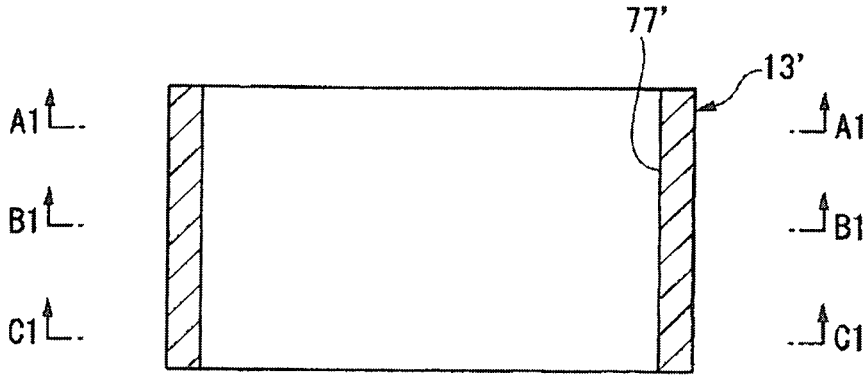
FIG. 3A is a cross-sectional view of a concentric and co-diametral cylinder, the inner periphery of which is not biased in a direction of a central axis. The cylinder is cut through at a surface that passes through the central axis.
Figure 3B:
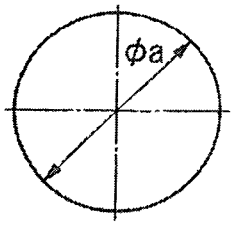
FIG. 3B is its inner periphery taken along the line A1-A1 in FIG. 3A.
Figure 3C:
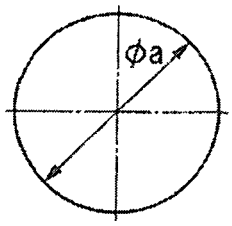
FIG. 3C is its inner periphery taken along the line B1-B1 in FIG. 3A.
Figure 3D:
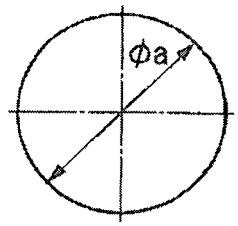
FIG. 3D is its inner periphery taken along the line C1-C1 in FIG. 3A.
Figure 4:
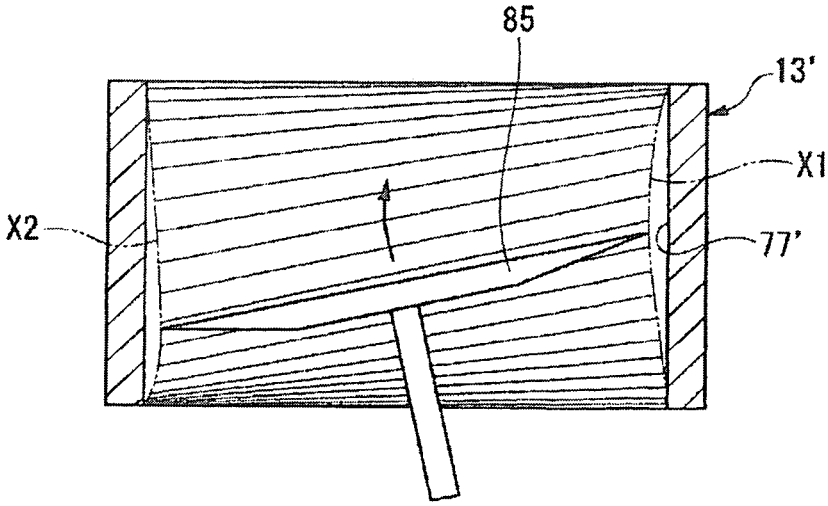
FIG. 4 is a cross-sectional view showing: a concentric and co-diametral cylinder, the inner periphery of which is not biased in a direction of a central axis; and a piston portion. The cylinder is cut through at a surface that passes through the central axis and cut at a surface along an oscillatory direction of a piston.
Figure 5:
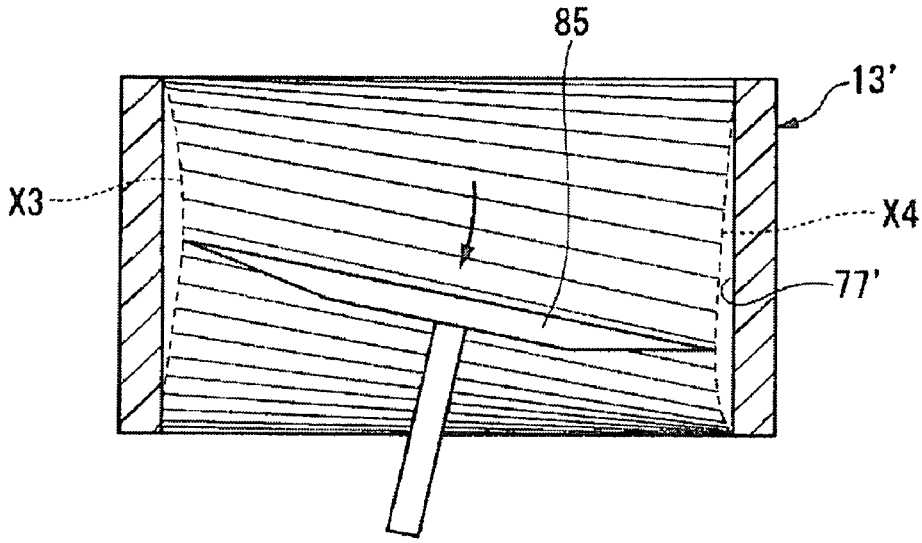
FIG. 5 is a cross-sectional view showing: a concentric and co-diametral cylinder, the inner periphery of which is not biased in a direction of a central axis; and a piston portion. The cylinder is cut through at a surface that passes through the central axis and cut at a surface along an oscillatory direction of a piston.
Figure 6:
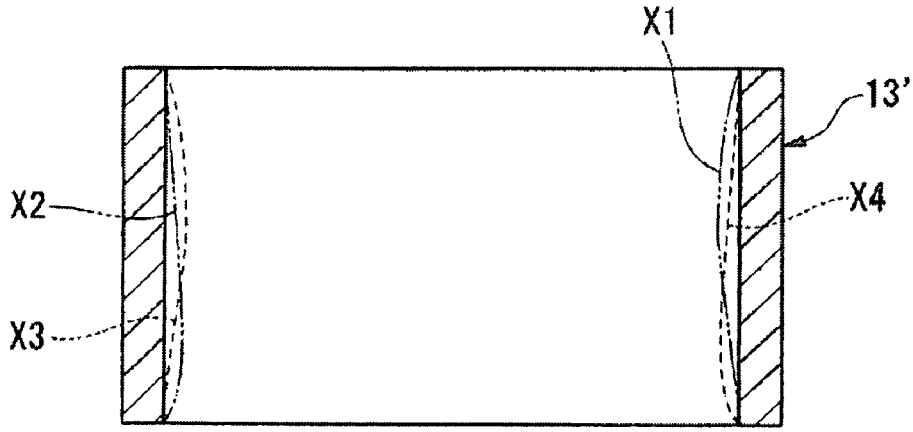
FIG. 6 is a cross-sectional view showing a concentric and co-diametral cylinder, the inner periphery of which is not biased in a direction of a central axis. The cylinder is cut through at a surface that passes through the central axis and cut at a surface along an oscillatory direction of a piston.
Figure 7A:
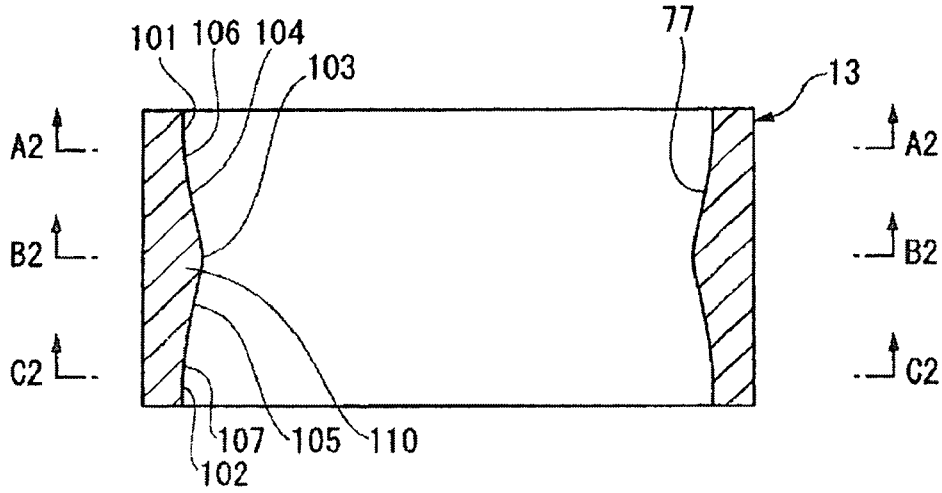
FIG. 7A is a cross-sectional view showing a cylinder according to a first embodiment where the cylinder is cut through at the central axis and along an oscillatory direction of a piston.
Figure 7B:
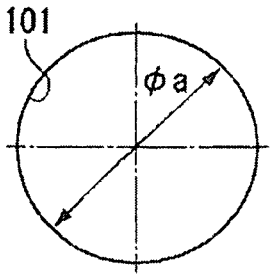
FIG. 7B is its inner periphery taken along the line A2-A2 in FIG. 7A.
Figure 7C:
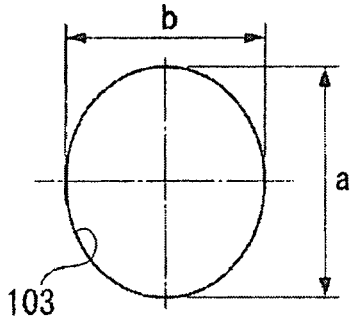
FIG. 7C is its inner periphery taken along the line B2-B2 in FIG. 7A.
Figure 7D:
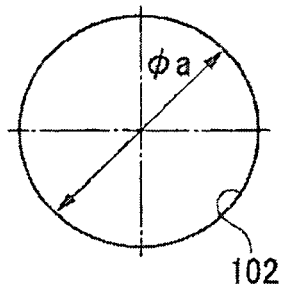
FIG. 7D is its inner periphery taken along the line C2-C2 in FIG. 7A.
Figure 8:
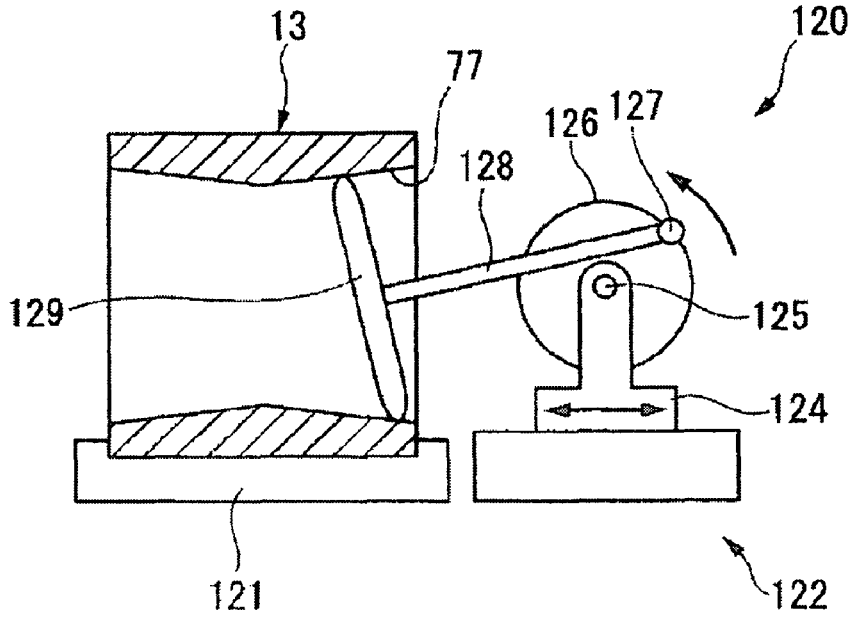
FIG. 8 is a cross-sectional view showing a manufacturing method of a cylinder apparatus.
Figure 9:
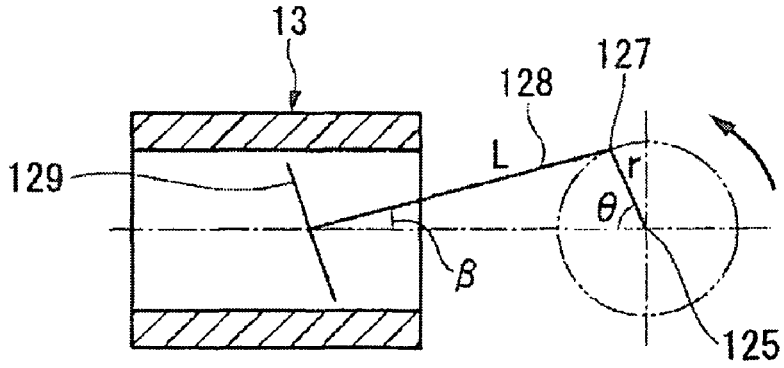
FIG. 9 is a cross-sectional view showing fundamental principles of the manufacturing method of the cylinder apparatus.
Figure 10:
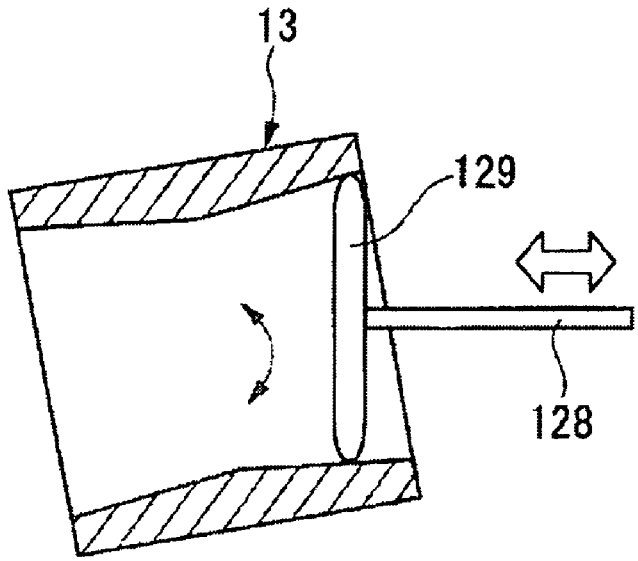
FIG. 10 is a cross-sectional view showing another manufacturing method of the cylinder apparatus.
Figure 11:
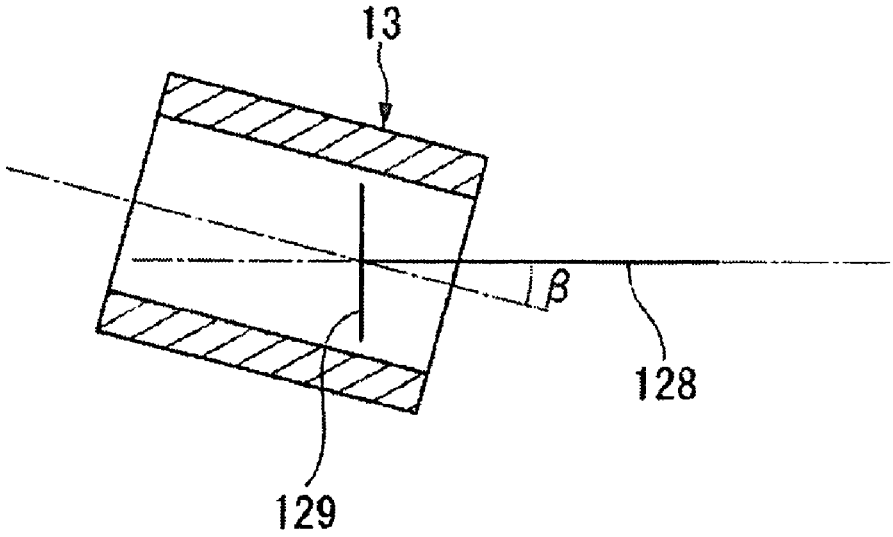
FIG. 11 is a cross-sectional view showing fundamental principles of another manufacturing method of the cylinder apparatus.

FIG. 1 is a cross-sectional view showing an overall architecture of a compressor including a cylinder apparatus according to a first embodiment of the present invention. FIG. 2 is a cross-sectional view showing featured portions of the compressor including the cylinder apparatus. FIG. 3A is a cross-sectional view of a concentric and co-diametral cylinder, the inner periphery of which is not biased in a direction of a central axis. The cylinder is cut through a surface that passes through the central axis; FIG. 3B is an inner periphery taken along the line A1-A1 in FIG. 3A; FIG. 3C is an inner periphery taken along the line B1-B1 in FIG. 3A; and FIG. 3D is an inner periphery taken along the line C1-C1 in FIG. 3A. FIG. 4 is a cross-sectional view showing: a concentric and co-diametral cylinder, the inner periphery of which is not biased in a direction of a central axis; and a piston portion. The cylinder is cut through at the central axis and along an oscillatory direction of a piston. FIG. 4 also indicates two-dot-chain-line trajectories made by tips of the piston portion moving in an oscillatory manner through a compression process of the piston portion. FIG. 5 is a cross-sectional view showing: a concentric and co-diametral cylinder, the inner periphery of which is not biased in a direction of a central axis; and a piston portion. The cylinder is cut through at the central axis and along an oscillatory direction of a piston. FIG. 5 also indicates broken-line trajectories made by tips of the piston portion moving in an oscillatory manner through an inhale process of the piston portion. FIG. 6 is a cross-sectional view showing a concentric and co-diametral cylinder, the inner periphery of which is not biased in a direction of a central axis. The cylinder is cut through at the central axis and along an oscillatory direction of a piston. FIG. 6 also indicates trajectories made by tips of the piston portion moving in an oscillatory manner through a compression process and an inhale process of the piston portion by two-dot-chain-line and broken-line, respectively. FIG. 7A is a cross-sectional view showing a cylinder according to a first embodiment where the cylinder is cut through at the central axis and along an oscillatory direction of a piston. FIG. 7B is an inner periphery taken along the line A2-A2 in FIG. 7A; FIG. 7C is an inner periphery taken along the line B2-B2 in FIG. 7A; and FIG. 7D is an inner periphery taken along the line C2-C2 in FIG. 7A. FIG. 8 is a cross-sectional view showing a manufacturing method of a cylinder apparatus. FIG. 9 is a cross-sectional view showing fundamental principles of the manufacturing method of the cylinder apparatus. FIG. 10 is a cross-sectional view showing another manufacturing method of the cylinder apparatus. FIG. 11 is a cross-sectional view showing fundamental principles of another manufacturing method of the cylinder apparatus.

As shown in FIG. 1, a compressor 11 is for compressing gas such as air and includes: a crankcase 12 placed at the bottom side as viewed in FIG. 1; a cylinder 13 arranged on the upper side of the crankcase 12; a valve plate 14 arranged on the upper side of the cylinder 13; and a cylinder head 15 arranged on the upper side of the valve plate 14.

The crankcase 12, formed into a tubed shape, has an opening 20 on one side thereof in a radial direction, and further comprises: a main configuration portion 21 arranged with a shaft line in a cross direction; and an upper configuration portion 22, formed into a tubed shape, projected outward from a circumference portion of the opening 20 of the main configuration portion 21 with an axis in a radial direction of the main configuration portion 21.

The cylinder 13 is formed into a tubed shape and arranged on an upper side of the upper configuration portion 22 of the crankcase 12 where being in a coaxial relation with the upper configuration portion 22.

The valve plate 14, as shown in FIG. 2, has a main valve plate 25 interposed between the cylinder 13 and the cylinder head 15. In the main valve plate 25, an intake port 26 and an exhaust port 27 are formed in a plate-thickness direction of the main valve plate 25 so as to penetrate through the cylinder 13 and the cylinder head 15. The valve plate 14 comprises an intake valve 31 and an exhaust valve 33. The intake valve 31 abuts to a surface of the main valve plate 25 from the side of the cylinder 13 so as to cover the intake port 26. The intake valve 31 is further attached to the main valve plate 25 by means of a screw 30. The exhaust valve 33 abuts to a surface of the main valve plate 25 from the side of the cylinder head 15 so as to cover the exhaust port 27. The exhaust valve 33 is further attached to the main valve plate 25 by means of a screw 32. The intake valve 31 and the exhaust valve 33 are both fabricated with plate material capable of being elastically deformed, so that the valves can be opened/closed by being detached from or attached to the main valve plate 25 by means of differential pressure between the cylinder 13 side and the cylinder head 15 side.

Inside of the cylinder head 15 includes a partition wall 36 so as to divide thereof into an intake chamber 37 placed over the intake port 26 and an exhaust chamber 38 placed over the exhaust valve 33. Further, as shown in FIG. 1, in the cylinder head 15, there are provided an intake opening 39 communicating the intake chamber 37 to the outside of the cylinder head 15 and an exhaust opening (not shown) communicating the exhaust chamber 38 to the outside of the cylinder head 15.

The compressor 11 comprises: a rotating shaft 45 provided at approximately center of a crank chamber 44 within the crankcase 12; a crank member 46 attached to the rotating shaft 45; and a key member 47 controlling a relative rotation of the rotating shaft 45 and the crank member 46.

The rotating shaft 45, being provided along the axis of the main configuration portion 21, is formed approximately into a circular cylinder shape. At an outer periphery surface of the rotating shaft 45, a key groove 50 is formed in a manner as to extend along the axis.

The crank member 46 is a circular disc formation, the outer periphery of which is formed into circular. In a position where being offset from diametral center of the crank member 46, a fitting hole 53 is provided. The fitting hole 53 is also provided with a key groove 54 at a place where opposite to the offset direction and along the axis.

In a state where the rotating shaft 45 is fitted into the fitting hole 53 of the crank member 46, the key groove 54 of the fitting hole 53 and the key groove 50 of the rotating shaft 45 are faced relative to each other. The key member 47, formed into a square-rode shape, is then fitted into the key grooves 50, 54 so as to have the rotating shaft 45 and the crank member 46 fixed in an integral manner. Accordingly, the crank member 46 is fixed to the rotating shaft 45 in eccentric state. By driving the rotating shaft 45 with a motor (not shown), the crank member 46 is rotated in eccentric state at center of the rotating shaft 45 that rotates at a fixed position.

The compressor 11 comprises: a bearing 57 retained by the crank member 46; an oscillatory member 58 retained by the bearing 57; and a rippling 59 as a seal member which is retained by the oscillatory member 58.

The bearing 57 includes: an inner ring 61; an outer ring 62, the diameter of which is larger than the inner ring 61; and a plurality of rolling elements 63 provided with the inner ring 61 that support the outer ring 62 capable of relatively rotating to the inner ring 61 in a coaxial manner. In the bearing 57, the outer periphery of the crank member 46 is fitted into the inner periphery of the inner ring 61.

The oscillatory member 58 comprises: a member main body 66 supported by the bearing 57; a retainer 67 provided with the member main body 66 where opposite to the side of the bearing 57, and catch the rippling 59 together with the member main body 66; and a plurality of bolts 68 (see FIG. 2) fixing the retainer 67 to the member main body 66.

As shown in FIG. 1, the member main body 66 comprises the following parts configured in an integral manner: a bearing retainer 71, circular in shape, for fitting the outer ring 62 of the bearing 57 therein; a connecting rod 72 extended outward from the bearing retainer 71 in its radial direction; a circular plate portion 73 crossing orthogonally with the connecting rod 72 at a place where opposite to the side of bearing retainer 71 of the connecting rod 72. The circular plate portion 73 is connected with the connecting rod 72 at the most intermediate portion of the circular plate portion 73. As shown in FIG. 2, the circular plate portion 73 comprises a fitting concavity 74 which is formed into circular with a coaxial relation with the circular plate portion 73 and concaves in certain depth. This fitting concavity 74 is configured at center of the circular plate portion 73 and at a place where opposite to the connecting rod 72. Accordingly, a circumference of the fitting concavity 74 is formed as a circular convexity 75 circularly projects in a direction opposite to the side of the connecting rod 72. The circular plate portion 73 comprises a plurality of threaded holes 76 formed at proper positions on the fitting concavity 74.

The retainer 67 is formed into approximately a circular plate. The retainer 67 comprises a fitting convexity 80 formed into circular at center of the retainer 67. The fitting convexity 80 projects in the axis direction thereof. Accordingly, a circumference of the fitting convexity 80 is formed into a circular stepped portion 81 in which to construct a stepped configuration. The retainer 67 comprises a plurality of screw mounting holes 82 penetrated thereinto in a thickness direction. The screw mounting holes 82 comprises: a linear insertion hole 83 provided at the intermediate portion of the retainer 67 in a plate-thickness direction and extended in a direction of the fitting convexity 80 so as to open through the fitting convexity 80; and a tapered counterboring portion 84 at the intermediate portion of the retainer 67 in a plate-thickness direction and extended in a direction opposite to the side of the fitting convexity 80 in a manner as to make its diameter widened as moving apart from the insertion hole 83. The fitting convexity 80 of the retainer 67 is fitted into the fitting concavity 74 of the member main body 66, so that the surface of the fitting convexity 80 is attached to the one of the fitting concavity 74. In this condition, positions of the screw mounting holes 82 can be adjusted so as to match the ones of the threaded holes 76 of the member main body 66. Both the circular plate portion 73 of the member main body 66 and the retainer 67 will constitute a piston portion (piston) 85 of the oscillatory member 58.

The bolts 68 comprises: a shank 88; a head portion 89 formed on one side of the shank 88 in its axis direction; and a male thread 90 where placed opposite to the side of the head portion 89 of the shank 88. The head portion 89 is tapered in such a manner that its diameter becomes smaller as moving toward the side of the shank 88. These bolts 68 are inserted into the screw mounting holes 82 of the retainer 67 and then screwed into the threaded holes 76 of the member main body 66. In this condition, the head portion 89 abuts against the counterboring portion 84 of the screw mounting holes 82, thereby generating fastening force. The retainer 67 is thus fixed to the member main body 66.

The rippling 59 is provided in such a manner as to fix to the circular plate portion 73 of the oscillatory member 58. The rippling 59 is formed into a closed-end cup configuration with resin material having self-lubricity. In more details, this rippling 59 comprises: a circular mounting portion 94, formed into a flat plate configuration and placed on the inner periphery side, caught between the circular convexity 75 of the member main body 66 and the circular stepped portion 81 of the retainer 67 by means of the bolts 68; and a circular lip portion 95 projected outward from the circular mounting portion 94 in its radial direction and curved into one axis direction so as to extend for a certain length covering the side of the outer periphery of the retainer 67.

In the oscillatory member 58, the piston portion 85 composed of the circular plate portion 73 of the member main body 66 and the retainer 67, and the rippling 59 retained by the piston portion 85 are arranged within the cylinder 13. In this condition, the circular lip portion 95 of the rippling 59 slidably abuts against an inner periphery 77 of the cylinder 13 thereby enabling to airtightly seal between the cylinder 13 and the oscillatory member 58. A portion surrounded by the piston portion 85, the rippling 59, the cylinder 13 and the valve plate 14 corresponds to a compression chamber 98.

In such a compressor 11, the rotating shaft 45 is rotated by driving a motor (not shown) so as to make the crank member 46 to be eccentrically rotated. According to the eccentric rotation of the crank member 46, the piston portion 85 of the oscillatory member 58 and the rippling 59 perform reciprocating motion within the cylinder 13 in the axial direction of the cylinder. Here, a cylinder apparatus 97 comprises the tube-shaped cylinder 13, and the circular piston portion 85 that performs reciprocating motion in the cylinder 13.

In an inhale process where the piston portion 85 and the rippling 59 move away from the valve plate 14, space of the compression chamber 98 expands according to the movement of the piston portion 85 of the oscillatory member 58 and the rippling 59. Here, while the exhaust valve 33 is closed, the intake valve 31 is opened so as to introduce gas such as air from the intake chamber 37 to the compression chamber 98. Then, in a compression process where the piston portion 85 and the rippling 59 move closer to the valve plate 14, space of the compression chamber 98 is reduced according to the movement of the piston portion 85 and the rippling 59 toward the valve plate 14. In this state, while the intake valve 31 is closed, the exhaust valve 33 is opened so as to exhaust compressed air from the compression chamber 98 to the exhaust chamber 38.

During the operation discussed above, the piston portion 85 performs reciprocating motion while being oscillated within the cylinder 13. That is, as viewed along the axis direction (crank shaft line direction) of the rotating shaft 45, when the crank member 46 is positioned on the most opposite side relative to the cylinder 13, the piston portion 85 makes space of the compression chamber 98 most expanded (i.e., the piston portion 85 is placed at a bottom dead point). In this state, the connecting rod 72 is positioned to be the most center within the cylinder (in a left-right direction) while the piston portion 85 is placed orthogonal to the axis of the cylinder 13. Then, the rotating shaft 45 and the crank member 46 are rotated to perform the compression process whereby the oscillatory member 58 is raised (i.e., moving toward the valve plate 14) so as to move the piston portion 85 in a direction of compressing the compression chamber 98. Up to an intermediate point between a top dead point (i.e., a point where the piston portion 85 reduces a space of the compression chamber 98 the most) and the bottom dead point, the bottom portion of the connecting rod 72 is being raised by moving thereof to either left or right side. At the most intermediate point between the top and bottom dead points, the crank member 46 is positioned at either left or right side the most while the bottom portion of the connecting rod 72 is placed at either left or right side the most. At this specific point, the piston portion 85 is inclined the most.

In a sequential manner, as moving toward the top dead point, the bottom portion of the connecting rod 72 is being returned to center (i.e. toward the central axis) of the cylinder 13. When reaching the top dead point which makes the space of the compression chamber 98 reduced the most, the crank member 46 is positioned on the most cylinder 13 side while the connecting rod 72 is placed at the most center of the cylinder 13. The piston portion 85 becomes parallel relative to the valve plate 14, and the compression process in sequence will be then completed.

In a state where the piston portion 85 is placed at the top dead point, the rotating shaft 45 and the crank member 46 are then rotated to start the inhale process. The oscillatory member 58 will move the piston portion 85 in a direction where making space of the compression chamber 98 expanded. Up to the intermediate point between the top and bottom dead points, the bottom portion of the connecting rod 72 descends (meaning moving away from the valve plate 14) while the bottom portion is being moved toward either left or right side but opposite side in the case of the compression process. At the most intermediate point between the top and bottom dead points, the crank member 46 is placed at either left or right side the most but opposite to the compression process. The bottom portion of the connecting rod 72 is placed outward the most (opposite side relative to the compression process). In this state the piston portion 85 is inclined the most (opposite side in the case of the compression process) relative to the axis of the cylinder.

In a sequential manner, as moving toward the bottom dead point, the bottom portion of the connecting rod 72 is being returned to center of the cylinder 13. At the bottom dead point where making space of the compression chamber 98 expanded the most, the connecting rod 72 is placed at the most center of the chamber 13. The piston portion 85 is then being placed orthogonal to the axis of the cylinder 13 so as to complete the inhale process.

As shown in FIG. 3, if an inner periphery 77' of a cylinder 13' is set to be concentric and co-diametral where not biased toward the axis of the cylinder 13', due to the oscillatory movement of the piston portion 85 described hereinabove, space created between the piston portion 85 and the inner periphery 77' of the cylinder 13' is inevitably varied according to positions of the piston portion 85 in the axis of the cylinder 13'. To be more specific, as discussed above, in a state where the piston portion 85, being in a circular shape, is placed orthogonal to the axis of the cylinder 13' (i.e., either at the top dead point or at the bottom dead point), the piston portion 85 has the least space relative to the inner periphery 77' of the cylinder 13'. When oscillated, the piston portion 85 keeps space in the axis of the rotating shaft 45 to be the same. However, the maximum distance in the oscillatory direction as viewed in the axis of the cylinder 13' (i.e., in the direction where being orthogonal to the axis of both the rotating shaft 45 and the cylinder 13') becomes shorter (between the top dead point and the bottom dead point) than when the piston portion 85 is placed either at the top dead point or the bottom dead point. Here, the maximum distance discussed above will be called hereinafter as an oscillatory distance.

Trajectories where the tip ends of the piston portion 85 forms in an oscillatory direction are shown in FIG. 4. Here, in the compression process, two-dot-chain-lines X1 and X2 constitute curved lines. That is, the trajectory X1 on the side where the crank member 46 is protruded (on the right side of FIG. 4) makes a distance relative to the central axis of the cylinder 13' to be moderately shorter as moving from the bottom dead point (bottom end side in FIG. 4) to the top dead point (top end side in FIG. 4). After the distance relative to the central axis of the cylinder 13' becomes shortest at a predetermined intermediate position where slightly moved to the top dead point side than center of the cylinder 13' in the axis direction, the distance relative to the central axis of the cylinder 13' becomes moderately longer as moved toward the top dead point. The distance relative to the central axis of the cylinder 13' in the trajectory X1 becomes the largest when the piston portion 85 is placed either at the top dead point or the bottom dead point.

On the other hand, the trajectory X2 on the opposite side where the crank member 46 is protruded (on the left side of FIG. 4) makes the distance relative to the central axis of the cylinder 13' to be moderately shorter as moving from the bottom dead point to the top dead point. After the distance relative to the central axis of the cylinder 13' becomes shortest at a predetermined intermediate position where slightly moved to the bottom dead point side than center of the cylinder 13' in the axis direction, the distance relative to the central axis of the cylinder 13' becomes moderately longer as moved toward the top dead point. The distance relative to the central axis of the cylinder 13' in the trajectory X2 becomes the largest when the piston portion 85 is placed either at the top dead point or the bottom dead point.

Further, in the compression process, one tip end of the piston portion 85 where the crank member 46 is protruded (right side in FIG. 4) is placed at a position where a distance relative to the central axis of the cylinder 13' is the shortest (referring to as position A). A distance between the position A and the top dead point of the piston portion 85 is referred to as a distance A. On the other hand, the other tip end of the piston portion 85 on the opposite side where the crank member 46 is protruded (left side in FIG. 4) is placed at a position where a distance relative to the central axis of the cylinder 13' is the shortest (referring to as position B). A distance between the position B and the bottom dead point of the piston portion 85 is referred to as a distance B. Here, the distance A is set larger than the distance B.

As the same as what discussed hereinabove, trajectories where tip ends of the piston portion 85 form in an oscillatory direction are shown in FIG. 5. Here, in the inhale process, broken-lines X3 and X4 constitute curved lines. That is, the trajectory X3 where the crank member 46 is projected (left side in FIG. 5) makes a distance relative to the central axis of the cylinder 13' to be moderately shorter as moving from the top dead point to the bottom dead point. After the distance relative to the central axis of the cylinder 13' becomes the shortest at a predetermined intermediate position where slightly moved to the top dead point side than center of the cylinder 13' in the axis direction, the distance relative to the central axis of the cylinder 13' becomes moderately longer as moved toward the bottom dead point. The distance relative to the central axis of the cylinder 13' in the trajectory X3 becomes the largest when the piston portion 85 is placed either at the bottom dead point or the top dead point.

On the other hand, the trajectory X4 on the opposite side where the crank member 46 is protruded (right side in FIG. 5) makes the distance relative to the central axis of the cylinder 13' to be moderately shorter as moving from the top dead point to the bottom dead point. After the distance relative to the central axis of the cylinder 13' becomes the shortest at a predetermined intermediate position where slightly moved to the bottom dead point side than center of the cylinder 13' in the axis direction, the distance relative to the central axis of the cylinder 13' becomes moderately longer as moved toward the bottom dead point. The distance relative to the central axis of the cylinder 13' in the trajectory X4 becomes the largest when the piston portion 85 is placed either at the bottom dead point or the top dead point.

Further, in the inhale process, one tip end of the piston portion 85 where the crank member 46 is protruded (left side in FIG. 5) is placed at a position where a distance relative to the central axis of the cylinder 13' is the shortest (referring to as position A). A distance between the position A and the top dead point of the piston portion 85 is referred to as a distance A. On the other hand, the other tip end of the piston portion 85 on the opposite side where the crank member 46 is protruded (right side in FIG. 5) is placed at a position where the distance relative to the central axis of the cylinder 13' is the shortest (referring to as position B). A distance between the position B and the bottom dead point of the piston portion 85 is referred to as a distance B. Here, the distance A is set larger than the distance B.

As become clear in FIG. 6 where the trajectories X1 to X4 are superimposed on each other, the trajectories where the tip ends of the piston portion 85 form in an oscillatory direction make the distance relative to the central axis of the cylinder 13' to be the largest either at the top dead point or the bottom dead point. In a state where the piston portion 85 is placed between the top and bottom dead points, the distance relative to the central axis of the cylinder 13' will become shorter.

Accordingly, in order to minimize space in an oscillatory direction between the inner periphery 77 of the cylinder 13 and the piston portion 85 which is varied in the axis direction of the cylinder 13, regardless of positions of the piston portion 85 performing reciprocating motion, it is preferable to form the inner periphery 77 of the cylinder 13 corresponding with oscillatory trajectories along which an outer periphery of the piston portion 85 forms. Further, the oscillatory distance is set as the largest at positions where corresponding to the top dead point and the bottom dead point of the piston portion 85 in the axis direction. Between the positions in the axis direction where corresponding to the top dead point and the bottom dead point of the piston portion 85, it is preferable to provide the oscillatory distance which is shorter than the one where corresponding to the top and bottom dead points of the piston portion 85.

Thus, in order to enable the reciprocating motion and oscillatory movement of the piston portion 85 and to minimize the space between the inner periphery 77 of the cylinder 13 and the piston portion 85 varied in the axial direction of the cylinder 13, as shown in FIG. 7, the cylinder 13 in a first embodiment is configured as that the inner periphery 77 of the cylinder 13 corresponds with the oscillatory trajectories along which the outer periphery of the piston portion 85 moves and that the oscillatory distance is set shorter between the top and bottom dead points of the piston portion 85 than the one where corresponding to the top and bottom dead points of the piston portion 85.

To be more specific, the diameter of the cylinder 13 in the axis of the rotating shaft 45 is set constant as "length a" which is not biased toward the axis of the rotating shaft 45. Further, center of each line segments is arranged at co-center in the axis. Still further, at a top dead point side end 101 placed in a given region where starting from the position corresponding to the top dead point of the piston portion 85 to the position slightly moved downward to the bottom dead point, the oscillatory distance of the cylinder 13 is set constant as the "length a" where not biased into the axis of the cylinder 13. A cross section of the cylinder 13 passing orthogonal to the axis thereof will be a circle arranged on the center point of the each line segment, and not be biased toward the axis of the cylinder 13. That is, the cylinder 13 is configured to be circle having the same shape with the piston portion 85 at the top dead point.

Moreover, at a bottom dead point side end 102 placed in a given region where starting from the position corresponding to the bottom dead point of the piston portion 85 to the position slightly moved upward to the top dead point, the oscillatory distance of the cylinder 13 is set constant as the "length a" where not biased toward the axis direction of the cylinder 13. A cross section of the cylinder 13 passing orthogonal to the axis thereof will be a circle arranged at co-center in the axis, and not be biased toward the axis of the cylinder 13. That is, the cylinder 13 is configured to be a circle having the same shape with the piston portion 85 at the bottom dead point.

Compared with the top dead point side end 101 and the bottom dead point side end 102, at an intermediate portion 103 placed between the top and bottom dead points of the piston portion 85, the oscillatory distance of the cylinder 13 is set shorter than the one of the "length a." At the shortest "length b," the cross section of the cylinder 13 passing orthogonal to the axis thereof will be ellipse arranged its center (centroid) at co-center in the axis. And, the oscillatory distance at a top dead point intermediate portion 104 connecting the intermediate portion 103 and the top dead point side end 101 will be further linear as moving toward the top dead point. At a bottom dead point intermediate portion 105 connecting the intermediate portion 103 and the bottom dead portion side end 102, the oscillatory distance will be further linear as moving toward the bottom dead point. Further, at boundaries between the top dead point side end 101 and the top dead point intermediate portion 104, a curved portion 106 with a smooth curved line is provided so as to connect the top dead point side end 101 and the top dead point intermediate portion 104. Like the curved portion 106, a curved portion 107, a curved line, is provided so as to smoothly connect boundaries between the bottom dead portion side end 102 and the bottom dead point intermediate portion 105. At the portions covering the top dead point intermediate portion 104, the intermediate portion 103, and the bottom dead point intermediate portion 105, placed between the top and bottom dead portions of the piston portion 85, the inner periphery 77 of the cylinder 13 is fabricated in correspondence with oscillatory trajectories along which the outer periphery 77 of the piston portion 85 moves.

In other words, the cross section of the cylinder 13, which passes orthogonal to the axis of the cylinder 13, will be circular at the top dead point side end 101 and the bottom dead portion side end 102 while the cross section will be elliptic therebetween. Further, at the intermediate portion 103, a ratio between the longest transverse diameter and the shortest transverse diameter will be the largest, and the ratio will be reduced as moving apart from the intermediate portion 103 in the axis of the cylinder 13

Still further, as viewed from the cross section of the cylinder 13 where going along the oscillatory motion of the piston portion 85 and passing the center point of the rotating shaft 45 in its axis, there are provided projecting portions 110 at the intermediate portion 103 where making the inner periphery 77 of the cylinder 13 projected toward each other in comparison with the inner periphery 77 at the top and bottom dead points. These projecting portions 110 are provided on both sides of the inner periphery 77 of the cylinder 13 in the oscillatory direction of the piston portion 85. As making the above-described cross section rotated in a circumferential direction of the cylinder 13, height of the projecting portions 110 becomes decreased as the rotation angle increases. At a position where the cross section is rotated 90 degrees, there exists none of the projecting portions 110.

To be more specific, assuming that: inner circumferences of both the top dead point side end 101 and the bottom dead portion side end 102 of the cylinder 13 are set as a circle having a "cylinder diameter a" of 82 mm; a stroke of the piston portion 85 is set to be 60 mm; and a length of the connecting rod 72 is set to be 120 mm, an inner circumference of the intermediate portion 103 has ellipse, the "shortest transverse diameter b" of which becomes approximately 80 mm. Therefore, the "shortest transverse diameter b" of the inner circumference of the intermediate portion 103 becomes 2 mm shorter than the "cylinder diameter a" of the inner circumferences of both the top dead point side end 101 and the bottom dead portion side end 102 of the cylinder 13. This 2 mm difference is obviously prominent since a general working tolerance of cylinders is 20 μm~30 μm.

Hereinafter, a manufacturing method of the cylinder apparatus, that is, a processing method of the inner periphery of the cylinder 13, will be explained.

A manufacturing tool 120 as shown in FIG. 8 comprises: a retaining base 121 holding the tubed cylinder 13; and a processing device 122 processing the inner periphery of the cylinder 13 held by the retaining base 121 and being provided on a side of the retaining base 121.

The processing device 122 comprises: a moving base 124 movable in parallel with the central axis of the cylinder 13 held by the retaining base 121; a rotating plate 126 rotating at center of a revolving shaft 125 where being provided with the moving base 124 and crossing orthogonally with the central axis of the cylinder 13; an oscillatory shaft 127 where rotatable and being parallel with the revolving shaft 125 of the rotating plate 126; a turning shaft 128 rotatably retained with the oscillatory shaft 127; and a cutting member 129, formed into a circular disc, where fixed to a tip end of the turning shaft 128 at center thereof. Each rotation axis for the revolving shaft 125 and the oscillatory shaft 127 is controllable. The cutting member 129 is for processing the inner periphery of the cylinder 13, the outer diameter of which is provided with a cutting edge having a diameter approximately the same with the inner diameter of the cylinder 13. The cutting member 129 will be rotated relative to the cylinder 13.

In this processing device 122, the cutting member 129 is moved in a manner approximately the same with motion of the piston portion 85 whereby the inner periphery 77 of the cylinder 13 will be processed. In case the cutting member 129 is moved as the same with the piston portion 85, as shown in FIG. 9, an angle β defined by the central axis of the cylinder 13 and the central axis of the cutting member 129 can be expressed by the following formula, $$\beta=\sin-1\ (r/L\times\sin\theta)$$

where an angle defined by the central axis of the cylinder 13 (alternate long and short dash line) and a line connecting the revolving shaft 125 with the oscillatory shaft 127 is θ; a distance between the revolving shaft 125 and the oscillatory shaft 127 is r; and a distance between the oscillatory shaft 127 and the cutting member 129 is L.

In this processing device 122, based on the above relation, operation of the cutting member 129 is performed. That is, relative to materials of the cylinder 13 mounted on the retaining base 121, the turning shaft 128 is set to be rotatable in a coaxial relation with the central axis of the cylinder 13 in a pre-processing stage. The turning shaft 128 is then rotated so as to rotate the cutting member 129. Accordingly, the cutting edge where provided at the tip end of the outer diameter of the cutting member 129 is rotated in approximately the identical diameter with inner diameter of the cylinder 13.

In the above condition, the moving base 124 is moved toward the side of the cylinder 13 in its axial direction so as to make the cutting member 129 moved closer to the cylinder 13. With this, the cutting member 129 first fabricates the top dead point side end 101 to the cylinder 13. Then, while the moving base 124 is being moved toward the side of the cylinder 13 in its axial direction, the cutting member 129 is relatively oscillated against the cylinder 13 by controlling the revolving shaft 125 and the oscillatory shaft 127 of the processing device 122 thereby performing the cutting process of the cylinder 13. Specifically, by rotating the revolving shaft 125 and the oscillatory shaft 127, processing of the cutting member 129 is performed while keeping a state that center of the cutting member 129 is arranged on the axis of the cylinder 13. Here, an angle of the turning shaft 128 relative to the axis of the cylinder 13 becomes larger as the cutting member 129 moves further, meaning that the cutting member 129 is being inclined to one side relative to the outer periphery of the cylinder 13 as the cutting member 129 moves further. With this, the top dead point intermediate portion 104 can be fabricated to the cylinder 13.

Next, the moving base 124 is moved away from the cylinder 13 in its axial direction wile controlling the revolving shaft 125 and the oscillatory shaft 127 of the processing device 122 so as not to make the cutting member 129 interfered with the inner periphery 77 of the cylinder 13. After the cutting member 129 is moved away from the cylinder 13, the cutting member is inclined to the other side, opposite to the above, in a state where the center of the cutting member 129 is arranged on the axis of the cylinder 13. In this state, the moving base 124 is moved again toward the cylinder 13 in the axis direction.

At a place where the cutting member 129 just passes the intermediate portion 103 of the cylinder 13, the revolving shaft 125 and the oscillatory shaft 127 are rotated so as to process the cylinder 13 while keeping a state that center of the cutting member 129 is arranged on the axis of the cylinder 13. Here, an angle of the turning shaft 128 relative to the axis of the cylinder 13 becomes smaller as the cutting member 129 moves further. With this, the bottom dead point intermediate portion 105 can be fabricated to the cylinder 13. Lastly, by making the turning shaft 128 turned in a coaxial relation with the center axis of the cylinder 13, the cutting member 129 is moved on the center axis of the cylinder 13, making the bottom dead point side end 102. Or, after the top dead point side end 101 and the top dead point intermediate portion 104 are fabricated to the cylinder 13 in the manner discussed above, and the cutting member 129 is moved away from the cylinder 13, it may be possible to turn over the cylinder 13 from side to side so as to fabricate the bottom dead point side end 102 and the bottom dead point intermediate portion 105 in the same manner discussed above.

Furthermore, since it is possible to perform a cutting processing of the cylinder 13 in a manner where the cutting member 129 is relatively moved in the axis direction of the cylinder 13, and relatively oscillated to the cylinder 13, it may be possible to constitute the cutting member 129 capable for only rotation and the cylinder 13 capable of being oscillated while moving in the axis direction. In other options, it may be possible to constitute the cutting member 129 incapable for rotation but to constitute the cylinder 13 capable of being rotated and being oscillated while moving in the axis direction of the cylinder 13. In these cases hereinabove, while making the angle β defined by the central axis of the cylinder 13 and the central axis of the cutting member 129 (see FIG. 11) based on the above formula, the cylinder 13 is oscillated while moving in its axis direction.

As shown in FIG. 3, in case the concentric and co-diametral cylinder 13', the inner periphery of which is not biased in its central axis direction, is applied, the piston portion 85 performs reciprocating motion with oscillatory movement. Especially in a type that the oscillatory member 58, in which the connecting rod 72 and the piston portion 85 are integrally fabricated not capable for a relative rotation, is employed, and is performed for reciprocating motion by eccentric rotation with the crank member 46, it will be possible to achieve cylinders featured in low costs and low noises. However, it is inevitable to generate space between the piston portion 85 and the inner periphery 77' of the cylinder 13' in a direction where the piston portion 85 is oscillated.

For overcoming the above problem, in the conventional prior arts including hereinbefore-discussed Japanese Patent Application Laid-Open No. H07-91374, a rippling, which is deformable, is provided with a piston portion in order to close space between the piston portion and an inner periphery of a cylinder, which is generated when the piston portion is oscillated. However, sealing capability of the rippling is limited. For example, if eccentricity of a crank member is increased for making stroke of the piston portion lengthened, an oscillatory angle of the piston portion is enlarged so as to lose the sealing capability of the rippling. Accordingly, gas will leak out to a crank chamber resulting in deterioration of compression efficiency for the gas. According to this reason, conventionally the eccentricity of the crank member needs to be small. Also, in case of a booster compressor where intensifying pressure by further compressing primary gas once compressed, the gas is compressed into higher pressure, whereby the leaking amount of the gas into the crank chamber is increased.

In order to resolve the above problem, according to a first embodiment of the present invention, the cylinder 13 has a shorter oscillatory distance (distance b in FIG. 7(*c*)) between the top dead point and the bottom dead point than an oscillatory distance positioned at the top dead point and the bottom dead point (distance a in FIG. 7*c*). Here, an oscillatory distance of the intermediate portion 103 between the top and bottom dead points is set to be the shortest. Accordingly, even if the oscillatory member 58, in which the connecting rod 72 and the piston portion 85 are integrally fabricated not capable for a relative rotation, is employed, and is performed for reciprocating motion by eccentric rotation with the crank member 46 so as to oscillate the piston portion 85, it can keep space between the cylinder 13 and the piston portion 85 as much narrow as possible. Thus, it is possible to minimize the amount of compression gas leaking out into the crank chamber 44, thereby improving compression efficiency.

In addition, without increasing the amount of the compression gas leaking out into the crank chamber 44, it is possible to increase an eccentric rate of the crank member 46 so as to enlarge a stroke amount of the piston portion 85. With this, a higher compression rate is obtainable. Further, even if the first embodiment of the present invention is applied to a booster compressor where intensifying pressure by further compressing primary gas once compressed, it is possible to reduce the compression gas leakage into the crank chamber 44, thereby achieving energy saving.

Still further, in the oscillatory distance of the cylinder 13, the intermediate portion 103 placed between the top dead point and the bottom dead point of the piston portion 85 is set to be the shortest while the oscillatory distance is gradually extended as moving toward the top dead point intermediate portion 104 and the bottom dead point intermediate portion 105, both placed at either side of the intermediate portion 103. With this structure, measuring control will be easier.

In the cylinder 13, there are provided portions, in which the oscillatory distance is not varied, at the top dead point side end 101 in which to include the portion where corresponding to the top dead point of the piston portion 85 and at the a bottom dead point side end 102 in which to include the portion where corresponding to the bottom dead point of the piston portion 85. With this structure, processing will be easier.

In the manufacturing method discussed hereinabove, a tip end of the cutting member 129 (the same diameter with the inner periphery of the cylinder 13) for processing the inner periphery of the cylinder 13 is relatively rotated to the cylinder 13. Further, the cutting member 129 is relatively moved in an axis direction of the cylinder 13 while relatively oscillated to the cylinder 13. Accordingly, it is possible to fabricate by this cutting processing that the inner periphery of the cylinder 13 has a shorter oscillatory distance between the top and bottom dead points than an oscillatory distance positioned placed at the top and bottom dead points. With this manufacturing method, it is possible to fabricate the cylinder 13 which has some different shapes of the inner periphery 77 with a relatively easy cutting processing.

Further, the cylinder 13 is fixed onto the retaining base 121, and the cutting member 129 is rotated relative to the cylinder 13. With this, a rotational device can be miniaturized.

Still further, the cylinder 13 is fixed onto the retaining base 121, and the cutting member 129 is moved in the axial direction of the cylinder 13 while oscillated. With this, an actuating and oscillating device can be miniaturized.

On the other hand, it is possible to set the cutting member 129 to be irrotational but set the cylinder 13 to be rotational relative to the cutting member 129. With this, a device for the cutting member can be simplified, contributing to easy exchange of the cutting member.

In case the cylinder 13 is moved in its axis direction thereof relative to the cutting member 129 while oscillated, it makes possible to adjust both moving speeds and oscillatory angles. With this, the inner periphery 77 of the cylinder 13 between the top and bottom dead points can be fabricated into some complicated formations.

Hereinabove, the details of a first embodiment of the present invention has been discussed. Hereinbelow, some functional effects thereof will be discussed.

In the cylinder apparatus according to a first embodiment of the present invention, the inner periphery 77 of the cylinder 13, in which the piston portion 85 performs reciprocating motion while being oscillated, has a shorter oscillatory distance between the top dead point and the bottom dead point than an oscillatory distance positioned at the top dead point and the bottom dead point. With this, it is possible to minimize space generated between the piston portion 85 and the cylinder 13 so as to reduce gas leak to a crank chamber, Further, since the intermediate portion 103 of the cylinder 13 is fabricated to be the shortest in the oscillatory direction according to the first embodiment, measurement control will be easier.

Moreover, the cylinder 13 is provided with portions, in which the oscillatory distance is not varied, at the top dead point side end 101 in which to include the portion where corresponding to the top dead point and at the a bottom dead point side end 102 in which to include the portion where corresponding to the bottom dead point. With this, processing will be easier.

In the manufacturing method of the cylinder apparatus according to the first embodiment, the cutting member 129 for processing the inner periphery 77 of the cylinder 13 is relatively rotated to the cylinder 13. Further, the cutting member 129 is relatively moved in the axis direction of the cylinder 13 while relatively oscillated to the cylinder 13. Accordingly, it is possible to conduct cutting processing to the cylinder 13 as that the inner periphery 77 of the cylinder 13 has a shorter oscillatory distance between the top and bottom dead points than an oscillatory distance positioned placed at the top and bottom dead points. With this, it is possible to fabricate the cylinder 13 which has some different shapes of the inner periphery 77 with a relatively easy cutting processing.

Further, since the cutting member 129 is rotated relative to the cylinder 13, it is possible to miniaturize a device for rotation.

Still further, in case the cylinder 13 is made to rotate relative to the cutting member 129, a device for the cutting member 129 can be simplified, contributing to easy exchange of the cutting member 129.

Here, in case that the cylinder 13 is moved in its axis direction toward the cutting member 129 while being oscillated, it is possible to adjust moving speeds and oscillatory angles. Accordingly, the inner periphery 77 of the cylinder 13 between the top and bottom dead points can be fabricated into complicated formations.

Figure 12:
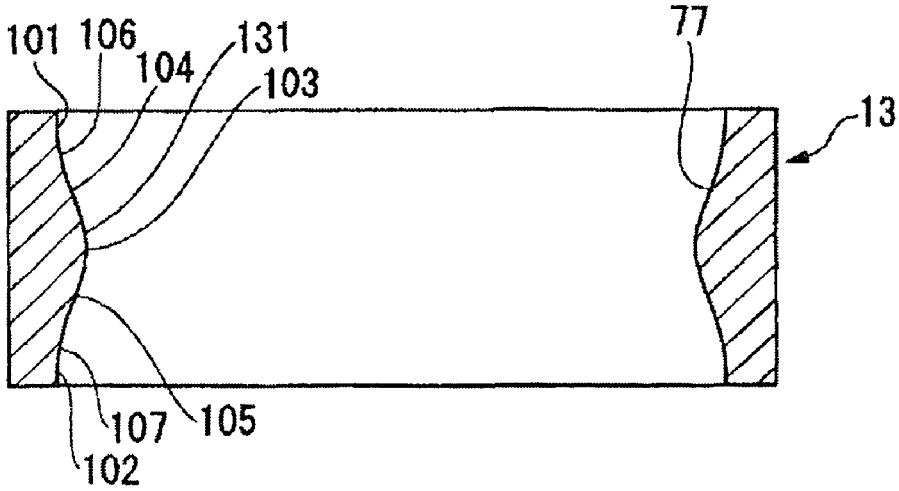
FIG. 12 is a cross-sectional view showing a cylinder according to a second embodiment where the cylinder is cut through at the central axis and along an oscillatory direction of a piston.

Next, the present invention according to a second embodiment will be hereinbelow explained with reference to FIG. 12. FIG. 12 is a cross-sectional view showing a cylinder where the cylinder is cut through at the central axis and along an oscillatory direction of a piston. Any components identical with or corresponding to those of the aforementioned first embodiment are denoted by the same reference numerals, and a detailed description thereof will be omitted below.

In the second embodiment, as shown in FIG. 12, the cylinder 13 has a curvilinear portion 131 where connecting the intermediate portion 103 of the cylinder 13 with the top dead point intermediate portion 104 and the bottom dead point intermediate portion 105 sandwiching the intermediate portion 103 in the axial direction of the cylinder 13. The connection is made through curvilinearity in section. An inflection point of the curvilinear connection is provided at the intermediate portion 103 of the cylinder 13.

In case of processing the cylinder 13 according to the second embodiment, it is possible to process the intermediate portion 103 by modifying movement and oscillation of the cutting member 129 in the first embodiment.

According to the second embodiment discussed above, the intermediate portion 103 does not have sharp edges, whereby durability for the rippling 59 can be improved.

Further, since the cylinder 13 has the curved inflection point at the intermediate portion 103, it is possible to effectively minimize space between the piston portion 85 and the cylinder 13.

Hereinbelow, some functional effects of the second embodiments will be discussed.

Since the intermediate portion 103 of the cylinder 13 is curvilinearly connected (curvilinear in section) with the top dead point intermediate portion 104 and the bottom dead point intermediate portion 105 sandwiching the intermediate portion 103 in the axial direction of the cylinder 13, the intermediate portion 103 does not contain sharp edges, contributing to improvement of durability for sealing members.

Moreover, since the cylinder 13 contains the curved inflection point at the intermediate portion 103, it is possible to effectively minimize space between the piston portion 85 and the cylinder 13.

Figure 13:
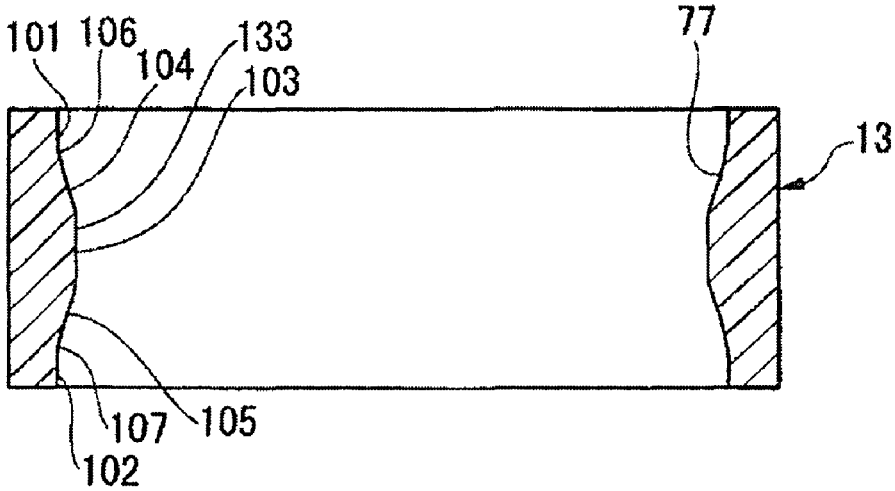
FIG. 13 is a cross-sectional view showing a cylinder according to a third embodiment where the cylinder is cut through at the central axis and along an oscillatory direction of a piston.

Next, the present invention according to a third embodiment will be explained with reference to FIG. 13. FIG. 13 is a cross-sectional view showing a cylinder where the cylinder is cut through at the central axis and along an oscillatory direction of a piston. Any components identical with or corresponding to those of the aforementioned first embodiment are denoted by the same reference numerals, and a detailed description thereof will be omitted below.

According to the third embodiment, as shown in FIG. 13, the cylinder 13 has a flat portion 133 where connecting the intermediate portion 103 of the cylinder 13 with the top dead point intermediate portion 104 and the bottom dead point intermediate portion 105 sandwiching the intermediate portion 103 in the axial direction of the cylinder 13. The connection is made through linearity in section. As a result, the cylinder 13 contains a portion at the intermediate portion 103 where the oscillatory distance is kept identical.

In order to process the cylinder 13 according to the third embodiment of the present invention, the cylinder 13 is first processed with the cutting member 129 to form the cylinder according to the first embodiment. The cutting member 129 is then moved toward the cylinder 13 in the axis direction of the cylinder 13 while inclining the cutting member 129 at a certain angle. In this state, the cutting member 129 processes the intermediate portion 103 linearly (linear in section) in the axis direction of the cylinder 13 so as to form the flat portion 133.

With this third embodiment discussed above, an area adjacent to the intermediate portion 103 will have linear formation in section. Since the intermediate portion 103 contains the area where the oscillatory distance is the same, the area adjacent to the intermediate portion can be processed easily.

Hereinafter, some functional effects as to the third embodiment will be discussed.

Since the cylinder 13 has the area where the intermediate portion 103 is connected with the top dead point intermediate portion 104 and the bottom dead point intermediate portion 105 sandwiching the intermediate portion 103 in the axial direction of the cylinder 13, the area can be processed easily.

Further, since the cylinder 13 has an area (the flat portion 133) at the intermediate portion 103 where the oscillatory distance is the same, the area can be processed easily.

Figure 14:
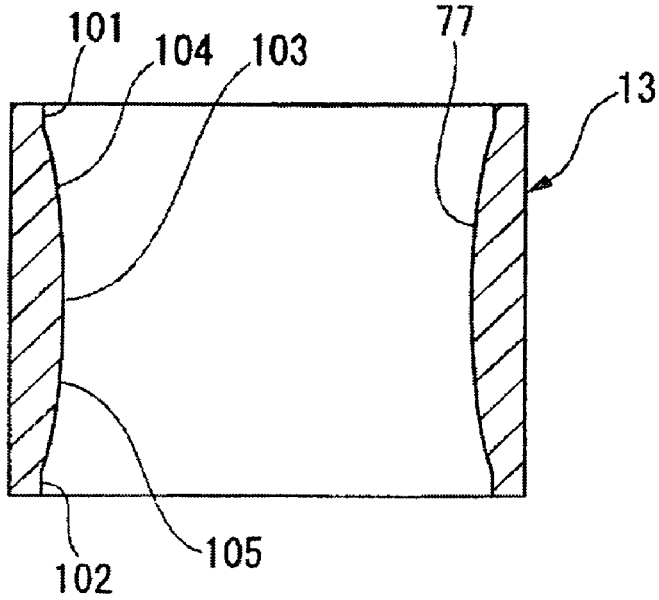
FIG. 14 is a cross-sectional view showing a cylinder according to a fourth embodiment where the cylinder is cut through at the central axis and along an oscillatory direction of a piston.
Figure 15:
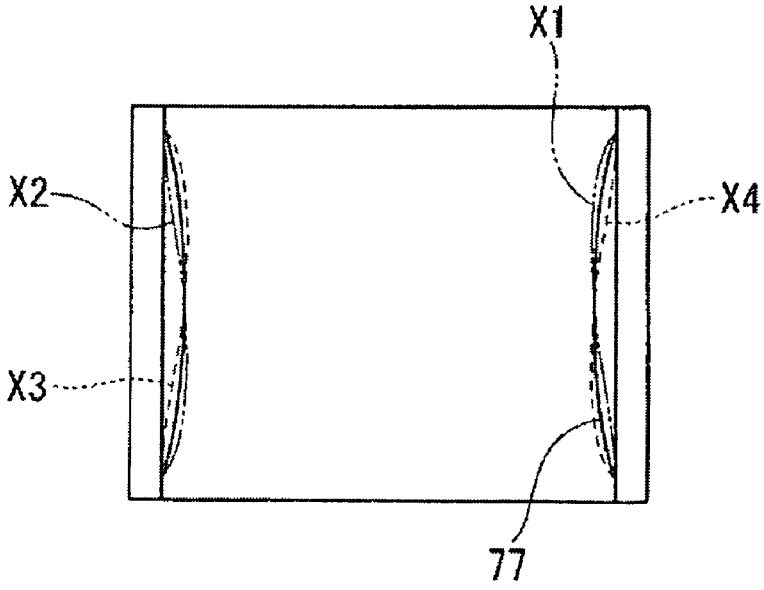
FIG. 15 is a cross-sectional view showing how to determine the inner periphery of the cylinder according to the fourth embodiment where the cylinder is cut through at the central axis and along an oscillatory direction of a piston.

Next, the present invention according to a fourth embodiment will be discussed with reference to FIGS. 14 and 15. FIG. 14 is a cross-sectional view showing a cylinder where the cylinder is cut through at the central axis and along an oscillatory direction of a piston. FIG. 15 is a cross-sectional view showing a setting method of the inner periphery of the cylinder according to the fourth embodiment where the cylinder is cut through at the central axis and along an oscillatory direction of a piston. Any components identical with or corresponding to those of the aforementioned first embodiment are denoted by the same reference numerals, and a detailed description thereof will be omitted below.

In the fourth embodiment, as shown in FIG. 14, the cylinder 13 has the inner periphery 77 where an area formed by the top dead point intermediate portion 104, the intermediate portion 103 and the bottom dead point intermediate portion 105 is defined with a solid line as shown in FIG. 15. Specifically, the solid line is placed right between two-dot-chain-line trajectories X1 and X2 made by tips of the piston portion 85 in oscillatory movement in a compression process and broken-line trajectories X3 and X4 made by tips of the piston portion 85 in oscillatory movement in an inhale process.

In case that the cylinder 13 according to the fourth embodiment is processed, it is possible to fabricate the cylinder 13 by modifying movement and oscillation of the cutting member 129 in the first embodiment.

According to the fourth embodiment discussed above, the cylinder 13 has the inner periphery 77 where an area formed by the top dead point intermediate portion 104, the intermediate portion 103 and the bottom dead point intermediate portion 105 is defined with a solid line as shown in FIG. 15, where the solid line is placed right between trajectories X1 and X2 made by tips of the piston portion 85 in oscillatory movement in a compression process and trajectories X3 and X4 made by tips of the piston portion 85 in oscillatory movement in an inhale process. With this, sealing performance by the rippling 59 can be maintained through the compression and inhale processes.

Figure 16:
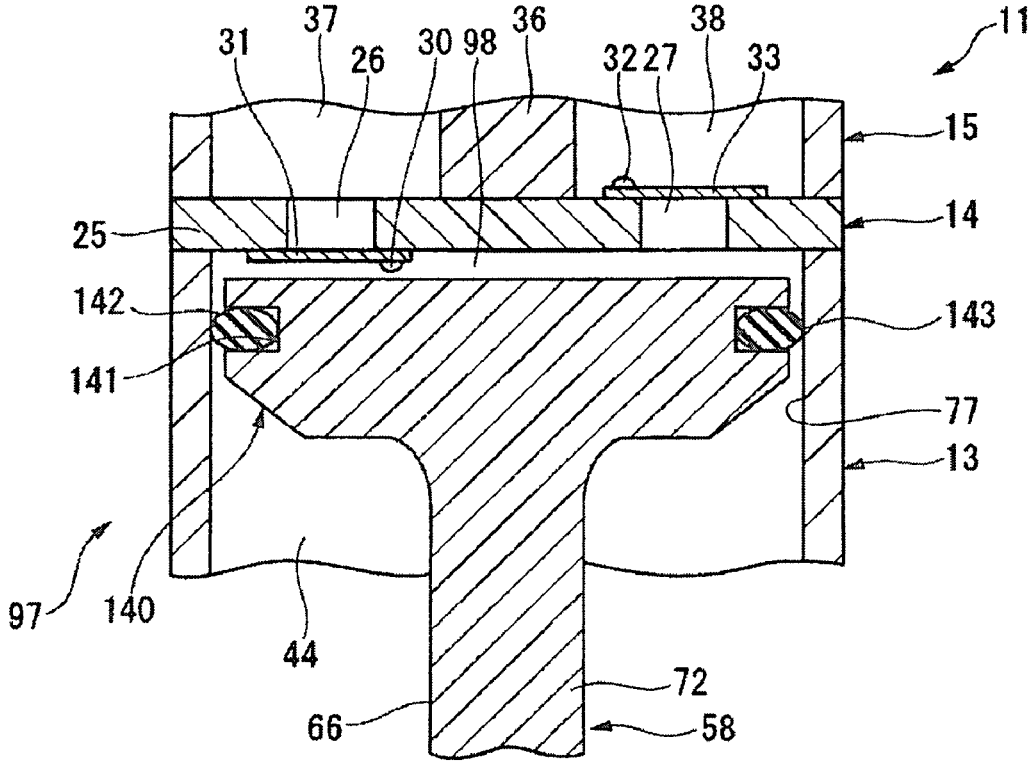
FIG. 16 is a cross-sectional view showing featured portions of the compressor including the cylinder apparatus.

Here, without dividing the oscillatory member 58 into the member main body 66 and the retainer 67, it is possible to form a piston 140 integrally with the oscillatory member 58 as shown in FIG. 16. Further, at the intermediate of the piston 140 in its axial direction may have a circular groove portion 141 making a recess toward the center of the piston 140 in a radius direction. An O-ring 142, circular in section, may be arranged at the groove portion 141 as a seal member where slidably contacting with the cylinder 13. Since the O-ring 142 is formed into circular in section, the exterior surface of the O-ring 142, that is, a meeting surface 143 slidably contacting with the inner periphery 77 of the cylinder 13 is formed into a circular shape projected outward in a radial direction.

By using the O-ring 142 as a sealing member where slidably contacting with the inner periphery 77 of the cylinder 13, sliding resistance can be reduced. In this case, as discussed above, the exterior surface of the O-ring 142 contains the meeting surface 143 where slidably contacting with the inner periphery 77 of the cylinder 13 and where formed into a circular shape projected outward in a radial direction. Here, a sealing ring having a semi-circular shape in section may be provided instead of the circular shape in section, at the groove portion 141. In this case, the sealing ring with the semi-circular shape in section may be arranged in a manner that the circular portion thereof is projected outward from the piston 140 in a radial direction.

That is, the sealing member is provided with the piston 140 and slidably contacts with the inner periphery 77 of the cylinder 13. Therefore, by making the cross section of the sealing member (the side slidably contacting with the inner periphery 77) circular, it is possible to reduce sliding resistance of the sealing member.

What is claimed is:

1. A compressor in an oscillatory method comprising:

a tubed cylinder;

a piston performing reciprocating motion between a top dead point and a bottom dead point with oscillatory movement in the cylinder;

an intake valve inhaling gas into the cylinder; and an exhaust valve exhausting gas from the cylinder, wherein the cylinder has, between the top dead point and the bottom dead point of the piston motion, an oscillatory distance that is shorter than an oscillatory distance at the top and bottom dead points, so that a ratio between the longest transverse diameter and the shortest transverse diameter is larger than a ratio between the longest transverse diameter and the shortest transverse diameter at the top and bottom dead points of the piston motion.

2. The compressor according to claim 1, wherein the shortest oscillatory distance is at an intermediate portion between the top dead point and the bottom dead point.

3. The compressor according to claim 2, wherein the cylinder has an inner periphery where an intermediate portion of the inner periphery is connected to both sides of the inner periphery in an axial direction of the cylinder as that the connection is made in a curvilinear formation in section.

4. The compressor according to claim 3, wherein the curvilinear formation has an inflection point at the intermediate portion of the inner periphery of the cylinder.

5. The compressor according to claim 1, wherein the cylinder includes a portion where an oscillatory distance is identical and is provided at either side of the top and bottom dead points where together covering area of the both top and bottom dead points.

6. The compressor according to claim 1, further comprising a seal member, wherein the seal member is provided with the piston so that the seal member slidably abuts to the cylinder, and the cross-sectional configuration of the seal member on the side where slidably abutting to the cylinder is circular.

7. A compressor in an oscillatory method comprising:

a tubed cylinder;

a piston performing reciprocating motion between a top dead point and a bottom dead point with oscillatory movement in the cylinder;

an intake valve inhaling gas into the cylinder; and an exhaust valve exhausting gas from the cylinder, wherein a cross-sectional configuration of the cylinder is identical with the one of the piston placed either at the top dead point and the bottom dead point, and the cross-sectional configuration of the cylinder placed between the top and bottom dead points is varied corresponding to a configuration formed by oscillatory trajectories along which an outer periphery of the piston moves;

wherein the shortest oscillatory distance is at an intermediate portion between the top dead point and the bottom dead point; and wherein the cylinder has an inner periphery where an intermediate portion of the inner periphery is connected to both sides of the interior in an axial direction of the cylinder as that the connection is made in a linear formation in section.

8. A compressor in an oscillatory method comprising:

a tubed cylinder;

a piston performing reciprocating motion between a top dead point and a bottom dead point with oscillatory movement in the cylinder;

an intake valve inhaling gas into the cylinder; and an exhaust valve exhausting gas from the cylinder, wherein a cross-sectional configuration of the cylinder is identical with the one of the piston placed either at the top dead point and the bottom dead point, and the cross-sectional configuration of the cylinder placed between the top and bottom dead points is varied corresponding to a configuration formed by oscillatory trajectories along which an outer periphery of the piston moves, and the cylinder includes in its inner periphery a portion where an oscillatory distance is identical and is provided at an intermediate portion of the inner periphery in an axial direction of the cylinder.

* * * * *